US006416303B1

(12) United States Patent
Van Der Sluis et al.

(10) Patent No.: US 6,416,303 B1
(45) Date of Patent: Jul. 9, 2002

(54) MECHANICALLY DRIVEN ROLLER VANE PUMP WITH APERTURE END PARTS PROVIDING FOR GRADUAL PRESSURE CHANGES IN THE PUMP CHAMBERS

(75) Inventors: Francis Maria Antonius Van Der Sluis, Sint-Michielsgestel; Johannes Gerardus Ludovicus Maria Van Spijk, Drunen, both of (NL)

(73) Assignee: Van's Doorne's Transmissie B.V. (NL)

( * ) Notice: Subject to any disclaimer, the term of this patent is extended or adjusted under 35 U.S.C. 154(b) by 0 days.

(21) Appl. No.: 09/675,565

(22) Filed: Sep. 29, 2000

Related U.S. Application Data

(63) Continuation of application No. PCT/NL00/00333, filed on May 17, 2000.

(51) Int. Cl.[7] ..... F04B 23/10; F04C 2/344
(52) U.S. Cl. ..... 418/225; 417/204
(58) Field of Search ..... 418/225; 417/204

(56) References Cited

U.S. PATENT DOCUMENTS

| | | | | | |
|---|---|---|---|---|---|
| 1,749,121 | A | * | 3/1930 | Barlow | 418/225 |
| 3,025,802 | A | * | 3/1962 | Browne | 418/225 |
| 3,072,067 | A | * | 1/1963 | Beller | 418/225 |
| 3,266,431 | A | | 8/1966 | Cook | 418/225 |
| 3,316,852 | A | | 5/1967 | Sadler | 418/225 |
| 4,080,124 | A | | 3/1978 | Drutchas et al. | 418/267 |
| 4,578,948 | A | * | 4/1986 | Hutson et al. | 417/204 |
| 4,828,468 | A | * | 5/1989 | Sipe et al. | 418/225 |

FOREIGN PATENT DOCUMENTS

| | | | | |
|---|---|---|---|---|
| DE | 3014080 | * | 10/1981 | 418/225 |
| EP | 0 921 314 A1 | | 6/1999 | |
| GB | 2 118 247 A | | 10/1983 | |

* cited by examiner

*Primary Examiner*—John J. Vrablik
(74) *Attorney, Agent, or Firm*—Todd Deveau; Ryan A. Schneider; Troutman Sanders LLP

(57) ABSTRACT

The invention relates to a roller vane pump suitable for pumping transmission fluid in an automatic transmission for motor vehicles. The pump is provided with a pump housing (2), a rotatable carrier (3) being located in the interior of the pump housing (2), a cam ring (5) surrounding the carrier (3) in radial direction, and roller elements (7) being provided in slots (6) in the carrier periphery. The spaces between the pump housing (2), the carrier (3), the cam ring (5) and the roller elements (7) define a number of pump chambers (8). Furthermore, the pump is provided with feed apertures (9) for allowing a flow of fluid to a pump chamber (8) and with discharge apertures (10) for allowing a flow of fluid from a pump chamber (8). According to the invention constructional measurements are taken to avoid the occurrence of cavitation and to obtain higher pump efficiency.

15 Claims, 8 Drawing Sheets

MECHANICALLY DRIVEN ROLLER VANE PUMP WITH APERTURE END PARTS PROVIDING FOR GRADUAL PRESSURE CHANGES IN THE PUMP CHAMBERS

CROSS-REFERENCE TO RELATED APPLICATION

This application is a continuation of prior application no. PCT/NL00/00333, filed May 17, 2000.

FIELD OF THE INVENTION

The present invention relates to a mechanically driven roller vane pump used for operating an automatic transmission for motor vehicles, in particular a continuously variable transmission (CVT).

BACKGROUND OF THE INVENTION

The roller vane pump comprises a pump housing, a carrier having a substantially circular cross section and being located in the interior of the pump housing, said carrier being rotatable by means of a drive shaft, a ring shaped cam ring having a non-circular inner surface and surrounding the carrier in radial direction, and substantially cylindrical roller elements being slidably provided in slots on the periphery of the carrier. The roller vane pump further comprises at least one feed aperture and at least one discharge aperture, said apertures being arranged in the pump housing and having a substantially elongated shape, the long axes of said apertures extending in a substantially tangential direction. Said apertures are divided into an inner aperture and an outer aperture by a narrow ridge. Said ridge supports the roller elements in axial direction.

On rotation of the carrier, the roller elements interact with an inner surface of the cam ring along contact lines there between, under influence of a pressure and/or a centrifugal force. The spaces between the pump housing, the carrier, the cam ring and the roller elements define pump chambers, which may arrive into communication with hydraulic channels in the pump housing through the feed apertures and the discharge apertures for allowing a flow of fluid to or from the pump chambers. The pump chambers are divided into cam chambers and carrier chambers, said cam chambers ranging from tangential centre planes of the roller elements radially outward, and said carrier chambers ranging from tangential centre planes of the roller elements radially inward, in which the tangential centre plane of a roller element is a plane that extends through the centre line of the cylindrical roller element in axial direction as well as in tangential direction, in other words, a plane that extends substantially parallel to the periphery of the carrier. Each roller element is associated with a leading cam chamber and a trailing cam chamber, the leading cam chamber ranging from a radial centre plane of the roller element in rotational direction, and the trailing cam chamber ranging from said radial centre plane of the roller element in anti-rotational direction, in which the radial centre plane of a roller element is a plane that extends in axial direction through the centre line of the cylindrical roller element as well as through the contact line between the roller element and the cam ring. Thus, a cam chamber that extends between two roller elements acts simultaneously as leading cam chamber for the roller element in anti-rotational direction and as trailing cam chamber for the roller element in rotational direction. As each roller element is associated with on the one side a carrier chamber and on the other side a leading cam chamber and a trailing cam chamber, each carrier chamber corresponds with a leading cam chamber and a trailing cam chamber.

The radius of curvature of the inner surface of the cam ring changes along the circumference of the cam ring. As a result, the volume of each pump chamber varies during rotation of the carrier, in connection with the tangential position of the pump chamber. When the volume of a pump chamber increases, the pressure in that chamber, i.e. the feed pressure, decreases, and fluid is drawn from a reservoir through hydraulic feed channels and the feed apertures into the pump chamber. Consequently, the tangential position of the feed apertures relative to the cam ring is such that the pump chambers arrive into contact with the feed apertures when the pump chamber volume increases. When the volume of a pump chamber decreases, fluid is discharged from said pump chamber through the discharge apertures and hydraulic discharge channels to a user of pressurised fluid, whereby a higher pressure, i.e. a discharge pressure, may be effected. Consequently, the tangential position of the discharge apertures relative to the cam ring is such that the pump chambers arrive into contact with the discharge apertures when the pump chamber volume decreases.

A roller vane pump as described in the above is known from the European patent 0.921.314 and is suitable for pumping automatic transmission fluid in hydraulically controlled and/or operated automatic transmissions for motor vehicles, in particular continuously variable transmissions. In a continuously variable transmission (CVT), such as a belt-and-pulley type CVT, a large flow of fluid may be required for control of the transmission ratio. Since the pump is driven by a shaft drivingly connected to the engine shaft, the pump is designed to be able to provide a desired pump yield, i.e. a desired flow rate at a desired pressure, even at the lowest rotational speed of the engine. On the other hand, the pump is also able to reliably cope with the extremely high pump yield that will be provided at the uppermost rotational speed of the vehicle engine.

Although the known roller vane pump functions satisfactory per se, it possesses the drawback that cavitation is apt to occur inside the known roller vane pump, amounting both to wear of pump parts and to noise generated by the pump.

SUMMARY OF THE INVENTION

At high rotational speeds of the vehicle engine, a high pump yield is provided, i.e. a large flow of fluid is discharged. To enable such large discharge flow, an equally large feed flow must be drawn to the pump. As the flow of the fluid through a feed aperture to a pump chamber is dependent of the level of an underpressure effected in the pump chamber and of the surface area of the respective aperture, wherein the surface area of the apertures in a pump is a constant, the underpressure required for drawing such large feed flow will be large as well, so that cavitation is apt to occur.

An aim of the invention is to reduce the noise generated by the pump and to reduce the wear of pump parts. This aim is, according to the insight underlying the present invention, achieved in enlarging the surface area of the apertures through which fluid is allowed to flow to and from the pump chambers. In particular, this aim is achieved in providing for a modified shape of the ridge, wherein at least one of an inner surface and an outer surface of the ridge extends substantially parallel to the cam ring surface over a substantial part of the tangential dimension of said ridge. At the same pump yield, a larger surface area of the apertures means a less extreme underpressure, i.e. a higher feed pressure in a pump chamber when in communication with the feed channels, which results in a reduction of noise generated by the pump and in a reduction of wear of pump parts. The surface area of the apertures in the known roller vane pump is smaller than said surface area in the pump according to the present invention, because in the known pump the ridge surfaces have the shape of a segment of a circle and extend substantially parallel to the circular periphery of the carrier. With this known shape of the ridge, the distribution of the flows of fluid among the inner aperture and the outer aperture is not well-balanced and not optimal for most tangential positions of the carrier.

In a preferred embodiment of the pump according to the invention, the surface area of the apertures is at a maximum, because the ridges are located such that the radial distance between the centre lines of the ridges and the cam ring surface is substantially equal to the radius of the roller elements. This configuration also provides an optimal axial support of the roller elements by supporting the roller elements centrally and over a maximum possible surface area of the roller elements for a given radial width of the ridges.

Another drawback of the known roller vane pump is that the roller elements are known to intermittently loose contact with the cam ring surface, which is particularly undesirable at the instance the fluid pressure in a pump chamber associated with a roller element changes from the feed pressure to the discharge pressure and vice versa. This undesired loss of contact amounts to wear of pump parts, noise generated by the pump and a decrease in pump efficiency.

The roller element looses contact with the cam ring surface when a force generated by a pressure difference between the carrier chamber and the corresponding cam chambers is directed radially inward and has a higher value than the centrifugal force, which is directed radially outward. The roller element then moves in radial inward direction under influence of a resultant force, which is directed radially inward, and looses contact with the cam ring surface. Such an undesired movement occurs when the fluid pressure in the carrier chamber is lower than the mean fluid pressure of the corresponding cam chambers.

An aim of the invention is to reduce the noise generated by the pump, to reduce the wear of pump parts, and to obtain higher pump efficiency. This aim is, according to the insight underlying the present invention, achieved in taking constructional measurements to ensure that the fluid pressure in the carrier chamber is always higher than, or at least equal to the mean fluid pressure of the corresponding cam chambers. In particular, this aim is achieved in providing for a modified arrangement of the apertures, wherein the feed aperture is shaped such that the leading cam chamber arrives into communication with the outer feed aperture before the corresponding carrier chamber arrives into communication with the inner feed aperture; and wherein the discharge aperture is shaped such that the carrier chamber arrives into communication with the inner discharge aperture before the corresponding leading cam chamber arrives into communication with the outer discharge aperture. In addition, the feed aperture can be shaped such that the communication between the carrier chamber and the inner feed aperture is cut off before the communication between the leading cam chamber and the outer feed aperture is cut off. Moreover, the discharge aperture can be shaped such that the communication between the leading cam chamber and the outer discharge aperture is cut off before the communication between the carrier chamber and the inner discharge aperture is cut off. Contrary to these aperture shapes, the aperture shapes in the known roller vane pump are such that the carrier chamber arrives into communication with the inner feed aperture before the corresponding leading cam chamber arrives into communication with the outer feed aperture, and the leading cam chamber arrives into communication with the outer discharge aperture before the corresponding carrier chamber arrives into communication with the inner discharge aperture. Also, the feed aperture is shaped such that the communication between the carrier chamber and the inner feed aperture and the communication between the corresponding trailing cam chamber and the outer feed aperture are cut off at approximately the same moment. In the roller vane pump according to the present invention the pressure in the carrier chamber will not become lower than the mean pressure of the corresponding cam chambers, so that the resultant force on the roller elements as a result of these pressures will not be oriented in a radially inward direction. The roller elements will thus maintain their interaction with the cam ring surface which results in a reduction of noise generated by the pump, a reduction of wear of pump parts and an increase in pump efficiency.

Another drawback of the known roller vane pump is that a chamber arrives in communication with an aperture rather suddenly, because the radial dimension of the apertures is almost immediately at a maximum. Consequently, the fluid pressure in the pump chamber changes abruptly, which results both in wear of pump parts as well as a high level of the noise generated by the pump.

An aim of the invention is to reduce the noise generated by the pump as well as the wear of pump parts. This aim is achieved providing an aperture with an end part extending in anti-rotational direction, such that at the location of said end part a pump chamber arrives into communication with the aperture through an opening there between, which opening has a constant radial width that is significantly less than that of the widest part of the aperture. Accordingly, the pressure in a pump chamber may be brought to the level prevailing in the hydraulic channel associated with the respective aperture in a defined and gradual manner, e.g. substantially without dynamic effects causing pressure fluctuations or vibrations, essentially before the fluid flow to or from the pump chamber starts.

It is remarked that an aperture with an end part extending in anti-rotational direction, at least a part of which has a significantly smaller radial dimension as the main part of the aperture, however, with a radial dimension which decreases in anti-rotational direction are well known in the technical field of rotary pump design, for instance from FR-A-2.095.994 or EP-A-0.200.294. According to the invention it was found that such known end part geometry is not optimal for the present type pump which is operable in a wide range of rotational speeds of the carrier. Analysis of the pressure changes occurring in the pump as a function of said rotational speed revealed that, although with the known end part geometry said pressure changes may be the most gradual at a certain rotational speed, at other rotational speeds they are still relatively abrupt. Using the end part geometry according to the invention, it is advantageously achieved that said pressure changes are sufficiently gradual for most rotational speeds of the carrier.

In a preferred embodiment of the pump according to the present invention, said end part is a slit formed by co-operation between the cam ring and the outer feed aperture, wherein the end part of the outer feed aperture is shaped such that it overlaps the cam ring in axial direction. This configuration may be manufactured easily and is therefore relatively cheap. It is remarked that the configuration of cam ring and outer feed aperture may alternatively also be adopted to cheaply form a slit-shaped end part having a radial width which decreases in anti-rotational direction.

In another preferred embodiment of the pump according to the present invention, said end part is a groove formed by a recess in the pump housing adjoining the carrier. The carrier chamber arrives into communication with the discharge aperture at the location of the groove, before arriving into communication with a part of the discharge aperture having a significantly larger radial dimension. With this construction, a less abrupt pressure increase in the carrier chamber is obtained than with the known construction wherein the carrier chamber arrives directly into communication with a discharge aperture having a relatively large radial dimension. With respect to the known constructions incorporating an end part having an radial width which increases in the direction of rotation of the carrier, the pump performance is improved in that for a substantial part of the range of rotational speeds of the carrier gradual pressure changes in the pump chamber are obtained.

It was found that a groove having a rectangular cross section is particularly suitable for a CVT-like application of the roller vane pump, wherein the pump must be able to cope with high pressures and a widely variable rotational speed of the carrier. Such a groove preferably has a depth in axial direction that increases in the direction of rotation of the carrier.

Due to the gradual pressure changes that will be achieved with the measure according to the invention, the noise generated by the pump is reduced as is the wear of pump parts.

In a preferred embodiment of the pump according to the present invention, the pump is provided with a gap between the roller elements and the carrier in tangential direction. The gap forms a channel through which corresponding cam and carrier chambers are in communication. These small channels contribute to a smoothing of the pressure differences between the carrier chamber and the cam chamber. If adopted in combination with an aperture having an end part according to the present invention, only one of the inner or the outer aperture needs to be provided with such end part. The pressure in a part of the pump chamber not associated with the said only one of the inner or the outer aperture is gradually changed through communication through said gap. It may thus advantageously be achieved that the fluid pressure in the chamber which is initially not in communication with an aperture, still is changed to some degree in accordance with the chamber which is in communication with an aperture, resulting in a smaller fluid pressure increase or decrease in the firstly mentioned chamber when it does arrive into communication with the aperture. In a preferred embodiment of the invention the width of the gap in tangential direction is dimensioned such that the rate at which the fluid pressure changes in the cam chamber during operation substantially corresponds to that in the carrier chamber. According to the invention the width of the gap in tangential direction may also be dimensioned such, that it corresponds to a minimum width in tangential direction required for allowing said pressure difference to become approximately zero. It is remarked, that taking a minimum width of the gap for achieving the above-mentioned requirements is highly advantageous, because then the amount of tangential movement and the tangential speed of the roller elements is limited, thereby limiting pump noise and wear. A width in tangential direction having a value in the range from 0.03 mm to 0.18 mm was found to be particularly suitable. In a presently favoured design of the roller vane pump such range corresponds to about 0.5 to 2.5 percent of a diameter of the roller element.

BRIEF DESCRIPTION OF THE DRAWINGS

The invention will now be explained in greater detail with reference to the non-restricting examples of the embodiment shown in the figures, in which similar parts are indicated with the same reference signs, and in which.

DETAILED DESCRIPTION OF THE PREFERRED EMBODIMENTS

Figure 1:
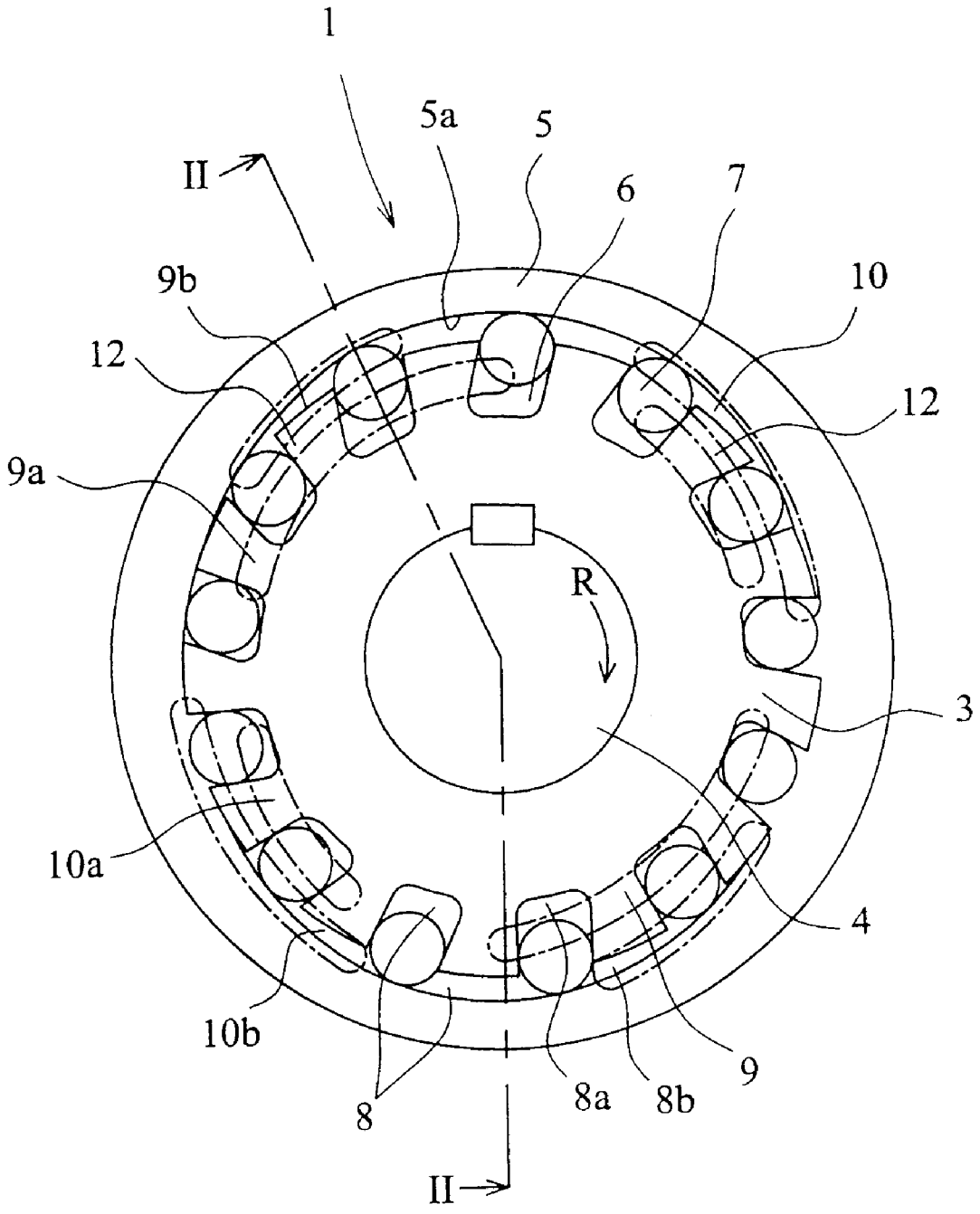
(PRIOR ART) Fig. 1
FIG. 1 shows an axial cross section of the inner pump parts of a known roller vane pump.
Figure 2:
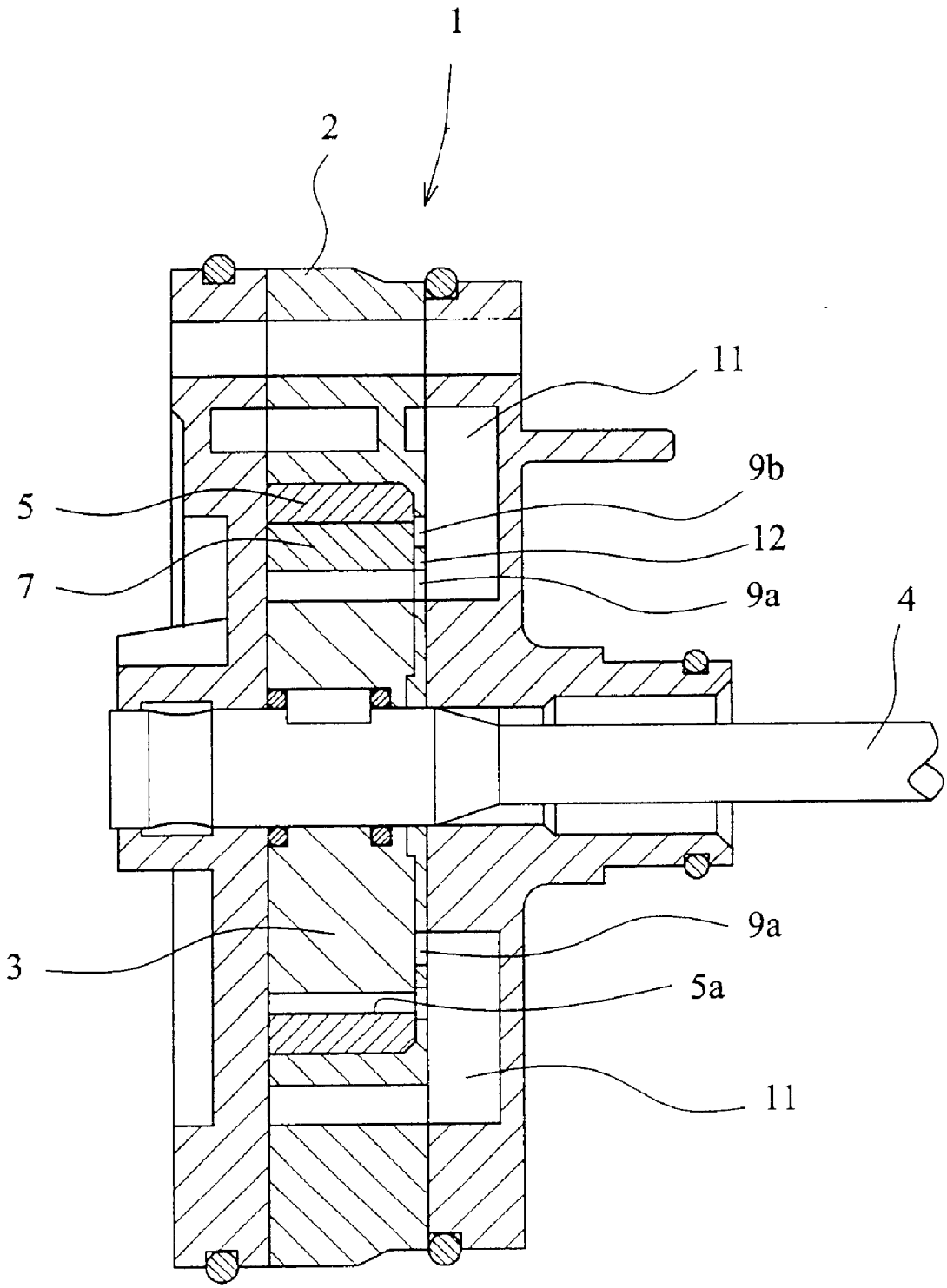
(PRIOR ART) Fig. 2
FIG. 2 shows a radial cross section II—II of the pump according to FIG. 1.

The FIGS. 1 and 2 show a known roller vane pump 1 provided with a pump housing 2, which pump housing 2 accommodates a substantially cylindrically shaped carrier 3 rotatable by means of a pump shaft 4. The rotational direction is indicated by arrow R. Furthermore, the known pump 1 is provided with a ring shaped cam ring 5 having a non-circular inner surface and radially surrounding the carrier 3, the cam ring 5 having an inner cam surface 5*a*. On its radial periphery, the carrier 3 is provided with slots 6 extending radially inward from its radially outer surface 3*a*. Each slot 6 accommodates a cylindrical roller element 7, the roller element 7 being radially movable in the slots 6.

During operation of the pump 1, the volumes of the spaces between the pump housing 2, the carrier 3, the cam ring 5 and the roller elements 7 alternately increase and decease, and therefore said spaces act as pump chambers 8. Said pump chambers 8 comprise carrier chambers 8*a* and cam chambers 8*b*, said carrier chambers 8*a* ranging from tangential centre planes of the roller elements 7 radially inward, and said cam chambers 8*b* ranging from said tangential centre planes radially outward, in which the tangential centre plane of a roller element 7 is a plane that extends essentially parallel to the periphery of the carrier 3 and through the centre line of said roller element 7. Each roller element 7 is associated with a leading cam chamber 8*b* and a trailing cam chamber 8*b*, the leading cam chamber 8*b* ranging from a radial centre plane of the roller element 7 in rotational direction, and the trailing cam chamber 8*b* ranging from said radial centre plane in anti-rotational direction, in which the radial centre plane of a roller element 7 is a plane that extends in axial direction through the centre line of said roller element 7 and through the line of contact between the roller element 7 and the cam ring 5. As each roller element 7 is associated with a carrier chamber 8*a* as well as a leading cam chamber 8*b* and a trailing cam chamber 8*b*, each carrier chamber 8*a* corresponds with a leading cam chamber 8*b* and a trailing cam chamber 8*b*.

Along its circumference, the cam surface 5*a* is provided with feed parts having an increasing radius in the rotational direction R of the carrier 3, so that the volume of a pump chamber 8 passing said feed part increases, discharge parts having a decreasing radius in the rotational direction R, so that the volume of a pump chamber 8 passing said discharge part decreases, and intermediate parts adjoining each of said feed part and said discharge part having a substantially constant radius, so that the volume of a pump chamber 8 passing an intermediate part is substantially constant. The intermediate parts are provided to prevent direct communication between a feed channel 11 for feeding fluid to the pump chambers 8 and a discharge channel (not shown) for discharging fluid from the pump chambers 8, as well as to allow a smooth transition between the underpressure and the overpressure of fluid present in a pump chamber 8.

The pump housing 2 is provided with feed apertures 9 and discharge apertures 10, for allowing a substantially axial flow of fluid between the pump chambers 8 and a hydraulic channel in the pump housing 2. The feed apertures 9 as well as the discharge apertures 10 have an elongated shape, the long axes of the apertures extending in a substantially tangential direction. Furthermore, the apertures 9,10 partially overlap the pump chambers 8 in axial direction. The tangential position of the-apertures 9,10 is associated with the shape of the cam surface 5*a*, in particular the clearance between the carrier 3 and the cam ring 5, as said clearance is variable as a result of the circular shape of the radial periphery of the carrier 3 and the changing radius of the cam surface 5*a*. In order for the pump 1 to function properly, the feed apertures 9 are located in the area in which said clearance increases, whereas the discharge apertures 10 are located in the area in which said clearance decreases. Each feed aperture 9 is divided into an inner feed aperture 9*a* and an outer feed aperture 9*b* by a narrow ridge 12. The radial position of the inner feed apertures 9*a* corresponds to the radial position of the carrier chambers 8*a*, whereas the radial position of the outer feed apertures 9*b* corresponds to the radial position of the cam chambers 8*b*. Similarly, each discharge aperture 10 is also divided into an inner discharge aperture 10*a* and an outer discharge aperture 10*b* by a narrow ridge 12, the radial position of the inner discharge apertures 10*a* corresponding to the radial position of the carrier chambers 8*a*, and the radial position of the outer discharge apertures 10*b* corresponding to the radial position of the cam chambers 8*b*. The narrow ridge 12 serves as an axial support for the roller elements 7.

During operation of the known roller vane pump 1, the carrier 3 is rotated by the pump shaft 4, wherein the roller elements 7 interact with the cam surface 5*a* under influence of a centrifugal force, and the volume of each pump chamber 8 increases and decreases alternately. When the volume of a pump chamber 8 increases, an underpressure is effected, and fluid will flow from a fluid reservoir (not shown) through the feed channel 11 and a feed aperture 9 to the pump chamber 8, whereas fluid will be discharged through a discharge aperture 10 and a discharge channel (not shown) to a user of pressurised fluid (not shown) under the influence of an overpressure when the volume of the pump chamber 8 decreases.

The known roller vane pump 1 as depicted in the FIGS. 1 and 2 comprises two feed apertures 9 and two discharge apertures 10, which are alternately provided in the pump housing 2, whereby two pumps are effectively obtained within one pump housing 2.

Figure 3:
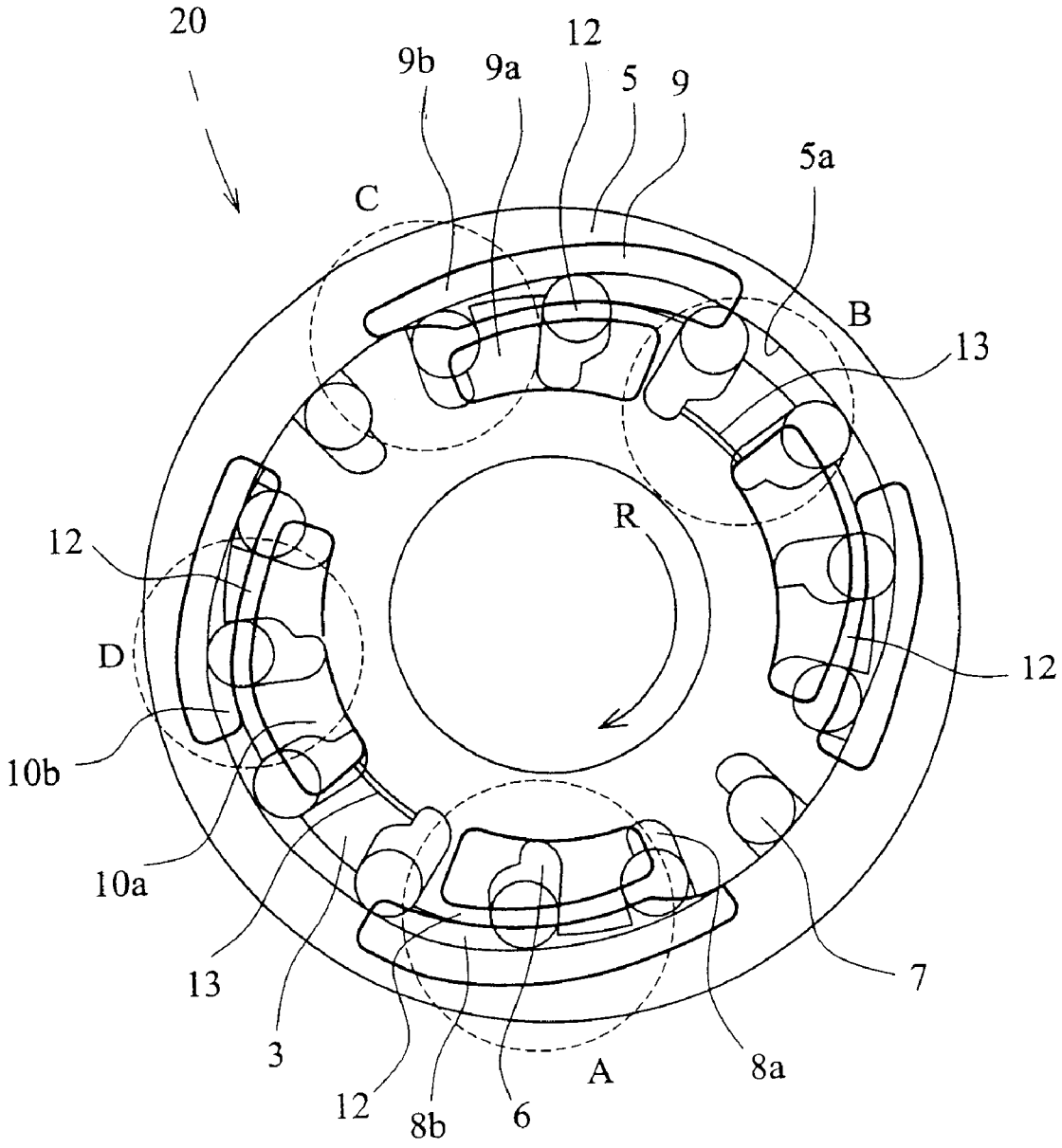
FIG. 3 shows an axial cross section of the inner pump parts of a preferred embodiment of a roller vane pump according to the invention.

FIG. 3 shows a preferred embodiment of a roller vane pump 20 according to the invention.

The roller vane pump 20 as depicted in FIG. 3 comprises a cam ring 5 with a cam surface 5*a* comprising two feed parts and two discharge parts, thereby effectively functioning as two pumps. However, the number of feed parts as well as the number of discharge parts does not necessarily have to be two, under the condition that both numbers are at least one. Advantageously, the roller elements 7 are provided in the slots 6 with a defined tangential tolerance between said roller elements 7 and the carrier 3, in order to allow fluid pressure differences between the carrier chambers 8*a* and the cam chambers 8*b* to minimise quickly.

In the roller vane pump 20 the outer feed aperture 9*b* extends beyond the inner feed aperture 9*a* in anti-rotational direction, whereas the inner discharge aperture 10*a* extends beyond the outer discharge aperture 10*b* in anti-rotational direction. Hereby, the leading cam chamber 8*b* arrives into communication with the outer feed aperture 9*b* before the corresponding carrier chamber 8*a* arrives into communication with the inner feed aperture 9*a*, and the carrier chamber 8*a* arrives into communication with the inner discharge aperture 10*a* before the corresponding leading cam chamber 8*b* arrives into communication with the outer discharge aperture 10*b* during operation of the pump 20.

In addition, FIG. 3 shows the option of the outer feed aperture 9*b* extending beyond the inner feed aperture 9*a* in rotational direction, whereby during operation of the pump the communication between the carrier chamber 8*a* and the inner feed aperture 9*a* is cut off before the communication between the leading cam chamber 8*b* and the outer feed aperture 9*b* is cut off. This optional shape of the feed aperture 9 contributes to not allowing the fluid pressure in the carrier chamber 8*a* to become lower than the resultant fluid pressure of the corresponding cam chambers 8*b*.

Figure 4:
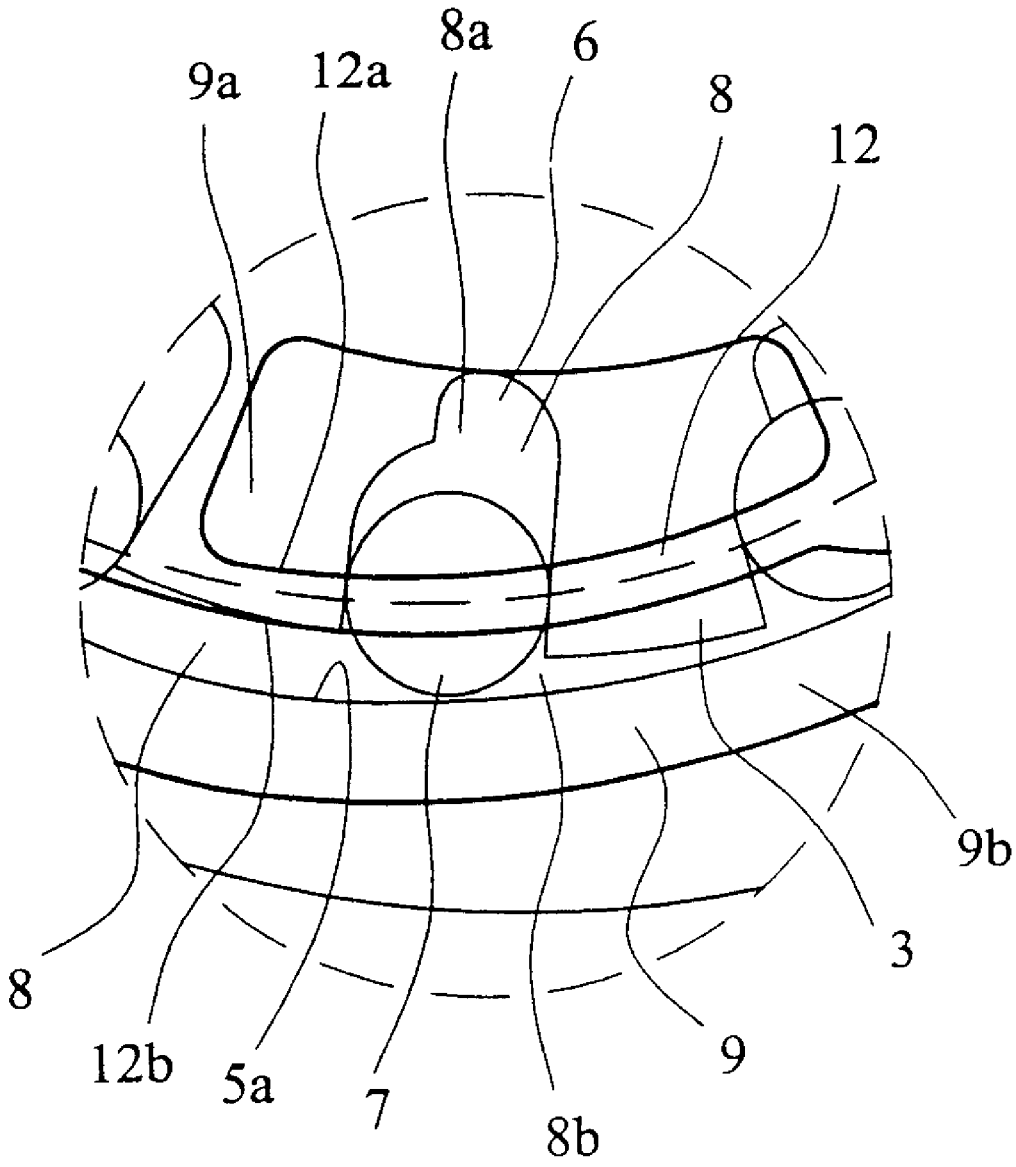
FIG. 4 shows a detail A of the pump according to FIG. 3.

FIG. 4 shows a detail of the roller vane pump 20, which is indicated by reference sign A in FIG. 3. In this example the ridge 12 between the inner feed aperture 9*a* and the outer feed aperture 9*b* is shown. Nevertheless, the following description is also valid in a context of the inner discharge aperture 10*a* and the outer discharge aperture 10*b*. The ridge 12 is limited in radial direction by an inner surface 12*a* and an outer surface 12*b*. Said surfaces 12*a*,12*b*extend substantially parallel to the inner cam surface 5*a*. It is not necessary that both surfaces 12*a*,12*b* are shaped like that, according to the invention, at least a substantial part of one of the surfaces 12*a*,12*b* has to have a shape that is substantially equal to the shape of the cam ring surface 5*a*. Furthermore, FIG. 4 shows the option of a radially outermost boundary surface of the outer feed aperture 9*b* extending substantially parallel to the inner cam surface 5*a*. Advantageously, the ridge 12 is located such that it centrally supports the roller elements 7 in axial direction, when said roller elements 7 interact with the cam surface 5*a*. With this arrangement, a maximum surface area of the feed apertures 9 through which fluid is allowed to flow to the pump chambers 8 is obtained. However, if the outer feed aperture 9*b* is provided with a port, allowing flow in radial direction, then the ridge 12 can advantageously be located radially outward in relation to the central position as described in the above. With such arrangement of the ridge 12, the flows of fluid to the carrier chambers 8*a* and in the cam chambers 8*b* can be substantially equal, whereby the development of a possibly unfavourable resultant force which causes the roller elements 7 to loose their interaction with the cam surface 5*a* can be avoided. Preferably, a radially innermost boundary surface of the inner feed aperture 9*a* is shaped like a segment of a circle. The radial position of said radially innermost boundary surface can then be substantially equal to the radial position of the radially innermost parts of the slots 6 on the periphery of the carrier 3.

Figure 5B:
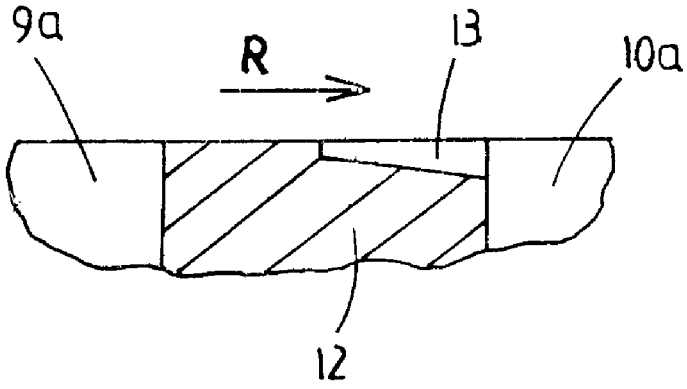
FIG. 5B shows a cross section VB—VB of the pump of FIG. 5A.
Figure 5A:
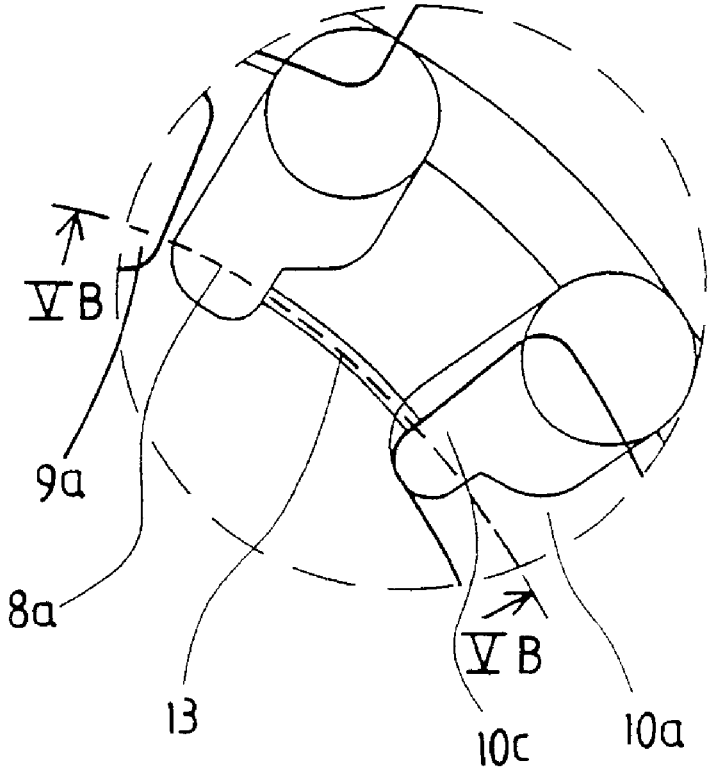
FIG. 5A shows a detail B of the pump according to FIG. 3.

FIG. 5 shows a detail of the roller vane pump 20, which is indicated by reference sign B in FIG. 3. In this detail a groove 13 extending from an end part 10*c* from the inner discharge aperture 10*a* in anti-rotational direction is shown. The radial position of the groove 13 is such that it may arrive into communication with carrier chambers 8*a*. Preferably, the groove 13 has a rectangular cross section, wherein the width of the groove 13 in radial direction is a constant, whereas the axial depth of the groove 13 in the direction of the inner discharge aperture 10*a* gradually increases.

Figure 6:
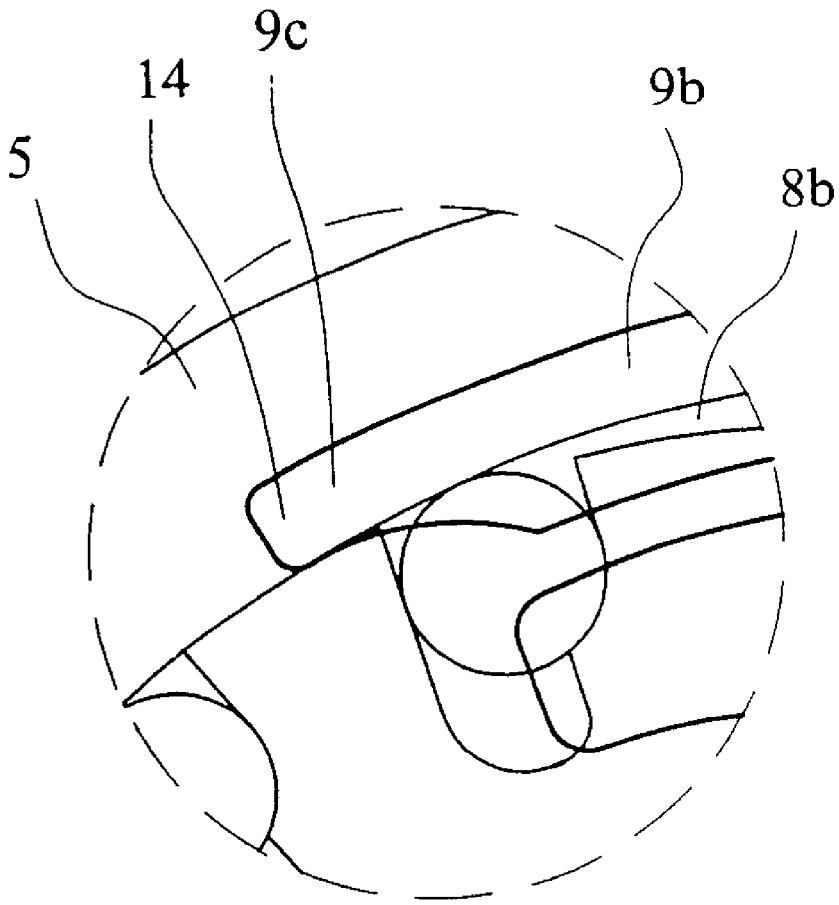
FIG. 6 shows a detail C of the pump according to FIG. 3.

FIG. 6 shows a detail of the roller vane pump 20, which is indicated by reference sign C in FIG. 3. This detail discloses an end part 9*c* of the outer feed aperture 9*b*. The end part 9*c* solely overlaps a part of the cam ring 5 in axial direction, and extends in anti-rotational direction, so that a slit 14 is formed there between. Thereby, cam chambers 8*b* arrive into communication with the outer feed aperture 9*b* through the slit 14 during operation of the pump 20. The construction according to the invention represents an advantageously simple and cost effective construction for realising the end part 9*c* of the respective aperture 9*b*. The width of the slit 14 in radial direction may be set constant or may show a gradual increases in rotational direction, whereby a constant width has the advantage as mentioned in the above.

Figure 7:
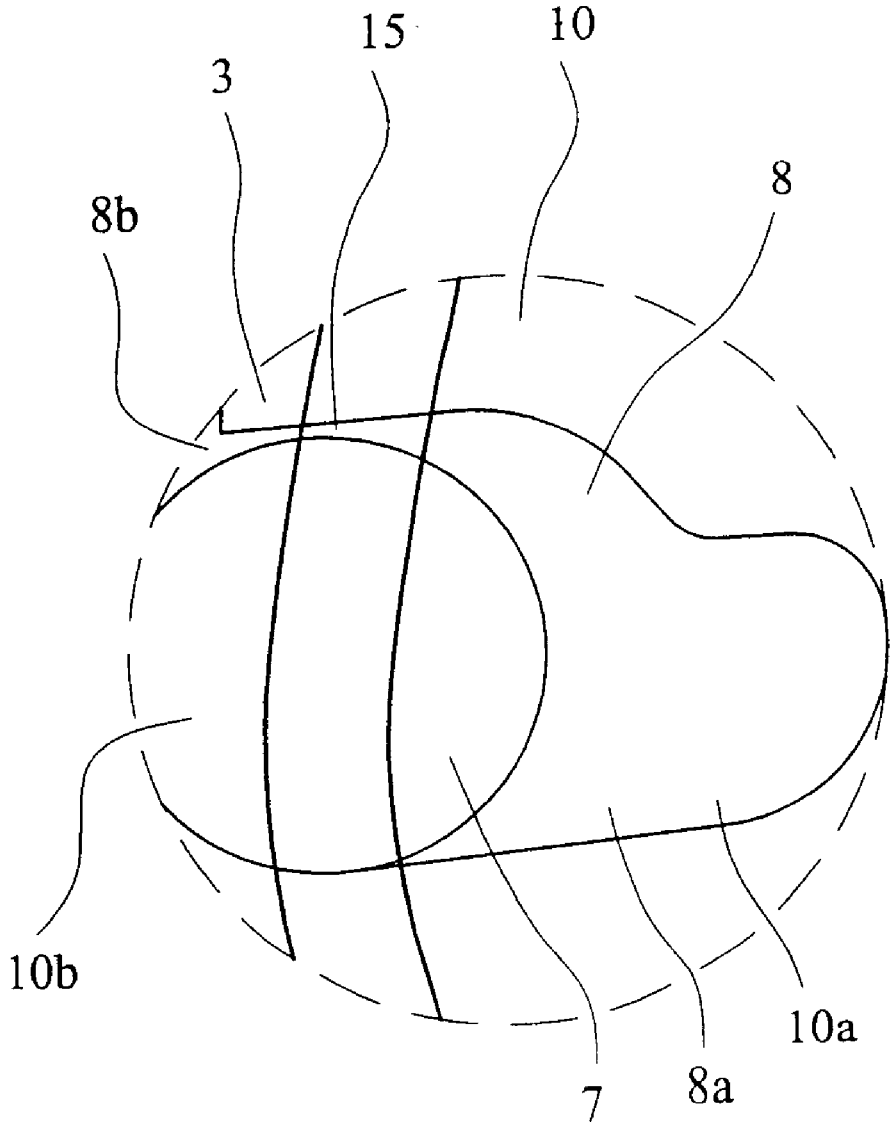
FIG. 7 shows a detail D of the pump according to FIG. 3.

FIG. 7 shows a detail of the roller vane pump 20, which is indicated by reference sign D in FIG. 3. This detail discloses a gap 15 between the roller element 7 and the carrier 3 in tangential direction. The gap 15 forms a channel through which the corresponding cam chambers 8*b* and carrier chamber 8*a* are in communication. If adopted in combination with the groove 13 or the slit 14 according to the present invention, only one of the inner or the outer aperture 9*a*, 10*a* or 9*b*, 10*b* needs to be provided with such groove 13 or slit 14, as shown in FIG. 3. Referring again to FIG. 7, the gap 15 advantageously achieves that the fluid pressure in a part 8*b* of the pump chamber 8 which is initially not in communication with the aperture 10, still is changed to some degree in accordance with a part 8*a* of the pump chamber 8 which is in communication with the aperture 10, resulting in a smaller fluid pressure increase or decrease in the firstly mentioned chamber 8*b* when it does arrive into communication with the aperture 10. According to the invention the tangential width of the gap 15 is preferably defined such, that it corresponds to a minimum tangential width required for allowing said pressure difference to become essentially zero. In this manner a freedom of movement of the roller element 7 in tangential direction is advantageously minimised.

Figure 8:
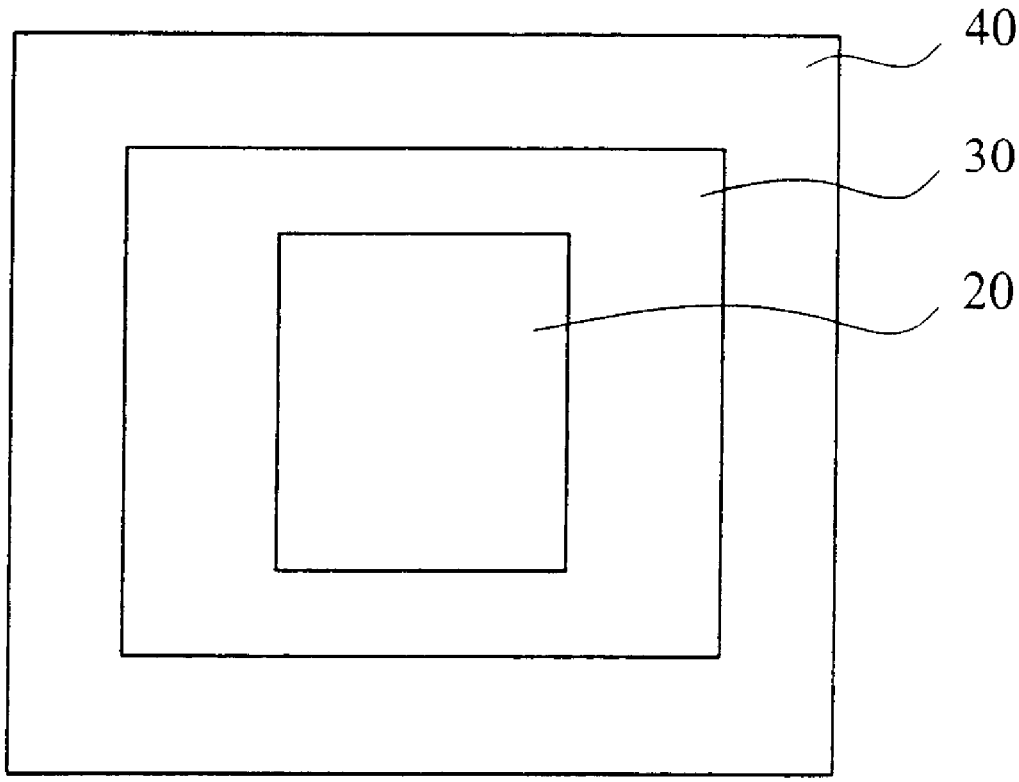
FIG. 8 shows a pump within a transmission of a motor vehicle.

FIG. 8 generally depicts the pump 20 of the present invention utilized within a transmission 30 of a motor vehicle 40.

It will be clear to a person skilled in the art that the scope of the present invention is not limited to the examples discussed in the foregoing, but that several amendments and modifications thereof are possible without deviating from the scope of the invention as defined in the attached claims.

What is claimed is:

1. Roller vane pump suitable for pumping transmission fluid in an automatic transmission for motor vehicles, in particular a continuously variable transmission, comprising:

a pump housing (2);

a drivably rotatable carrier (3) having a substantially circular cross section and being located in the interior of the pump housing (2), at its radial periphery being provided with slots (6) that extend in a direction substantially inward from the periphery;

a cam ring (5) having a non-circular inner surface (5*a*) and surrounding the carrier (3) in radial direction;

substantially cylindrical roller elements (7) being slidably provided in the slots (6) of the carrier (3), wherein the spaces between the pump housing (2), the carrier (3), the cam ring (5) and the roller elements (7) define pump chambers (8), wherein said pump chambers (8) are divided into cam chambers (8*b*) and carrier chambers (8*a*), the cam chambers (8*b*) ranging from tangential centre planes of the roller elements (7) radially outward, and the carrier chambers (8*a*) ranging from tangential centre planes of the roller elements (7) radially inward, each carrier chamber (8*a*) being associated with a leading cam chamber (8*b*) in rotational direction and a trailing cam chamber (8*b*) in anti-rotational direction;

at least one feed aperture (9) having a substantially elongated shape, a long axis of said feed aperture (9) extending in a substantially tangential direction, said feed aperture (9) being arranged in the pump housing (2) such that at least one pump chamber (8) is associated with a feed channel (11) in the pump housing (2) through the feed aperture (9), wherein said feed aperture (9) is divided into an inner feed aperture (9*a*) and an outer feed aperture (9*b*) by a ridge (12) having an inner surface (12*a*) and an outer surface (12*b*), said surfaces (12*a*,12*b*) extending in a substantially axial direction as well as in a substantially tangential direction; and at least one discharge aperture (10) having a substantially elongated shape, a long axis of said discharge aperture (10) extending in a substantially tangential direction, said discharge aperture (10) being arranged in the pump housing (2) such that at least one pump chamber (8) is associated with a discharge channel in the pump housing (2) through the discharge aperture (10), wherein said discharge aperture (10) is divided into an inner discharge aperture (8*a*) and an outer discharge aperture (10*b*) by a ridge (12) having an inner surface (12*a*) and an outer surface (12*b*), said surfaces (12*a*,12*b*) extending in a substantially axial direction as well as in a substantially tangential direction, wherein an inner or an outer aperture (9*a*,10*a*;9*b*,10*b*) is provided with an end part (9*c*,10*c*) extending in anti-rotational direction, such that at the location of said end part (9*c*,10*c*) said pump chamber (8) arrives into communication with said aperture (9*a*,10*a*;9*b*,10*b*) through an opening there between formed as a groove (13) in the pump housing (2) having an essentially constant radial width that is significantly less than that of the widest part of the aperture (9*a*,10*a*;9*b*,10*b*), whereby the axial depth of the groove (13) increases in rotational direction.

2. Roller vane pump according to claim 1, wherein the pump is provided with a gap (15) between the roller elements (7) and the carrier (3) in tangential direction allowing fluid communication there between for achieving a substantially equal fluid pressure in the carrier chamber (8*a*) and the cam chamber (8*b*).

3. Roller vane pump according to claim 2, wherein the width of said gap (15) in tangential direction is dimensioned such that a rate at which the fluid pressure changes in the cam chamber (8*b*) corresponds to a rate at which the fluid pressure changes in the carrier chamber (8*a*).

4. Roller vane pump according to claim 2, wherein the width of the gap (15) in tangential direction has a value in the range from 0.03 to 0.18 millimeter.

5. Roller vane pump according to claim 2, wherein the width of the gap (15) in tangential direction is about 0.5 percent to 2.5 percent of a diameter of a roller element (7).

6. Roller vane pump according to claim 2, wherein the width of said gap (15) in tangential direction is dimensioned such that the fluid pressures in the carrier chamber (8*a*) and in the cam chamber (8*b*) substantially correspond.

7. Roller vane pump according to claim 6, wherein the width of said gap (15) in tangential direction corresponds to a minimum width required for fluid pressures in the carrier chamber (8*a*) and in the cam chamber (8*b*) to substantially correspond.

8. Roller vane pump according to claim 1, wherein at least one of the inner surface (12*a*) and the outer surface (12*b*) of at least one ridge (12) extends substantially parallel to the cam ring surface (5*a*) over a substantial part of the tangential dimension of said ridge (12).

9. Roller vane pump according to claim 8, wherein at least one ridge (12) is located such that the radial distance between the centre line of the ridge (12) and the cam ring surface (5*a*) at least substantially corresponds, preferably is equal, to the radius of the roller elements (7).

10. Roller vane pump according to claim 8, wherein at least one ridge (12) is located such that the radial distance between a centre line of the ridge (12) and the cam ring surface (5*a*) is smaller than the radius of the roller elements (7).

11. Roller vane pump according to claim 1, wherein the feed aperture (9) is shaped such that the leading cam chamber (8*b*) arrives into communication with the outer feed aperture (9*b*) before the corresponding carrier chamber (8*a*) arrives into communication with the inner feed aperture (9*a*);

and wherein the discharge aperture (10) is shaped such that the carrier chamber (8*a*) arrives into communication with the inner discharge aperture (10*a*) before the corresponding leading cam chamber (8*b*) arrives into communication with the outer discharge aperture (10*b*).

12. Roller vane pump according to claim 11, wherein the feed aperture (9) is shaped such that the communication between the carrier chamber (8*a*) and the inner feed aperture (9*a*) is cut off before the communication between the leading cam chamber (8*b*) and the outer feed aperture (9*b*) is cut off.

13. Roller vane pump according to claim 11, wherein the discharge aperture (10) is shaped such that the communication between the leading cam chamber (8*b*) and the outer discharge aperture (10*b*) is cut off before the communication between the carrier chamber (8*a*) and the inner discharge aperture (10*a*) is cut off.

14. Automatic transmission for motor vehicles, in particular a continuously variable transmission, provided with a roller vane pump according to claim 1.

15. Motor vehicle provided with an automatic transmission, in particular a continuously variable transmission, the transmission being provided with a roller vane pump according to claim 1.

* * * * *